US008458817B1

(12) United States Patent
Babb

(10) Patent No.: US 8,458,817 B1
(45) Date of Patent: Jun. 11, 2013

(54) GLOVE HAVING DETACHABLE SEGMENTS WITH A RING ATTACHMENT

(76) Inventor: Jonathan J. Babb, Hafb, NM (US)

( * ) Notice: Subject to any disclaimer, the term of this patent is extended or adjusted under 35 U.S.C. 154(b) by 406 days.

(21) Appl. No.: 12/910,011

(22) Filed: Oct. 22, 2010

(51) Int. Cl.
*A41D 19/00* (2006.01)

(52) U.S. Cl.
USPC ..... 2/163; 2/159; 2/161.6; 2/161.7; 482/47; 482/48; 602/21; 602/22

(58) Field of Classification Search
USPC ..... 2/163, 160, 161.5, 161.1, 21, 16, 2/161.6; 482/48, 49, 4, 47, 148; 602/5, 20–22, 602/60–62
See application file for complete search history.

(56) References Cited

U.S. PATENT DOCUMENTS

| | | | | | |
|---|---|---|---|---|---|
| 474,929 | A | | 5/1892 | Tabor | |
| 1,358,824 | A | | 11/1920 | Burden | |
| 1,620,434 | A | | 3/1927 | Burden | |
| 2,118,463 | A | | 5/1938 | Eden | |
| 2,780,954 | A | * | 2/1957 | Bryce | 84/375 |
| 3,608,093 | A | | 9/1971 | Kirby | |
| 4,131,952 | A | | 1/1979 | Brenning, Jr. | |
| 4,408,358 | A | * | 10/1983 | Swan | 2/161.1 |
| 4,651,350 | A | | 3/1987 | Dawiedczyk | |
| 4,704,743 | A | | 11/1987 | Thornell | |
| 5,228,142 | A | * | 7/1993 | Yoswein-McGreen | 2/169 |
| 5,680,654 | A | | 10/1997 | McClanahan, II | |
| 5,687,424 | A | * | 11/1997 | Masley | 2/163 |
| 7,210,172 | B2 | | 5/2007 | Adams, Jr. | |
| 2009/0307821 | A1 | * | 12/2009 | Chang | 2/21 |

* cited by examiner

*Primary Examiner* — Danny Worrell
*Assistant Examiner* — Khaled Annis
(74) *Attorney, Agent, or Firm* — Neustel Law Offices

(57) ABSTRACT

The glove includes a base portion having a palm side and a back side adapted to cover a hand, the base portion having integral finger segments and also including detachable finger segments to extend from the base portion. The base portion includes base mounts encircling finger openings on an interior side and the detachable finger segments include finger mounts encircling the detachable finger segments on an exterior side. The detachable finger segments extend through finger openings of the base portion and the finger mounts interlock with the base mounts to secure the detachable finger segments to the base portion. The mounts, when in the connected state, are located on an interior side of the base portion to restrict visibility of the mounts and also restrict accidental engagement with foreign objects. The mounts each comprise a halved ring-structure having elastic elements connecting opposing halves for diametric adjustment of the mounts.

23 Claims, 8 Drawing Sheets

GLOVE HAVING DETACHABLE SEGMENTS WITH A RING ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a glove and more specifically it relates to a glove having detachable segments for efficiently attaching and detaching finger and thumb segments as needed.

2. Description of the Related Art

Any discussion of the related art throughout the specification should in no way be considered as an admission that such related art is widely known or forms part of common general knowledge in the field.

Many different types of gloves exist and gloves are comprised of various materials and thicknesses. At times when wearing gloves, it is desired to directly handle an object with a bare finger or thumb; however the glove wearer may not desire to remove the entire glove.

Different types of gloves have been manufactured to try and overcome this problem. One type of glove employs a cut section across the finger or thumb, wherein the user cuts the finger or thumb from the base of the glove when direct skin contact is desired. However, an obvious problem with this method is that after the finger or thumb section is removed, the section cannot generally be reattached.

Other types of gloves include hinged finger or thumb segments; however these can often times get in the way and may not form an efficient seal with the base portion of the glove when reattached. Because of the inherent problems with the related art, there is a need for a new and improved glove having detachable segments for efficiently attaching and detaching finger and thumb segments as needed.

BRIEF SUMMARY OF THE INVENTION

A system for efficiently attaching and detaching finger and thumb segments as needed. The invention generally relates to a glove which includes a base portion having a palm side and a back side adapted to cover a hand, the base portion having integral finger segments and also including detachable finger segments to extend from the base portion. The base portion includes base mounts encircling finger openings on an interior side and the detachable finger segments include finger mounts encircling the detachable finger segments on an exterior side. The detachable finger segments extend through finger openings of the base portion and the finger mounts interlock with the base mounts to secure the detachable finger segments to the base portion. The mounts, when in the connected state, are located on an interior side of the base portion to restrict visibility of the mounts and also restrict accidental engagement with foreign objects. The mounts each comprise a halved ring-structure having elastic elements connecting opposing halves for diametric adjustment of the mounts.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
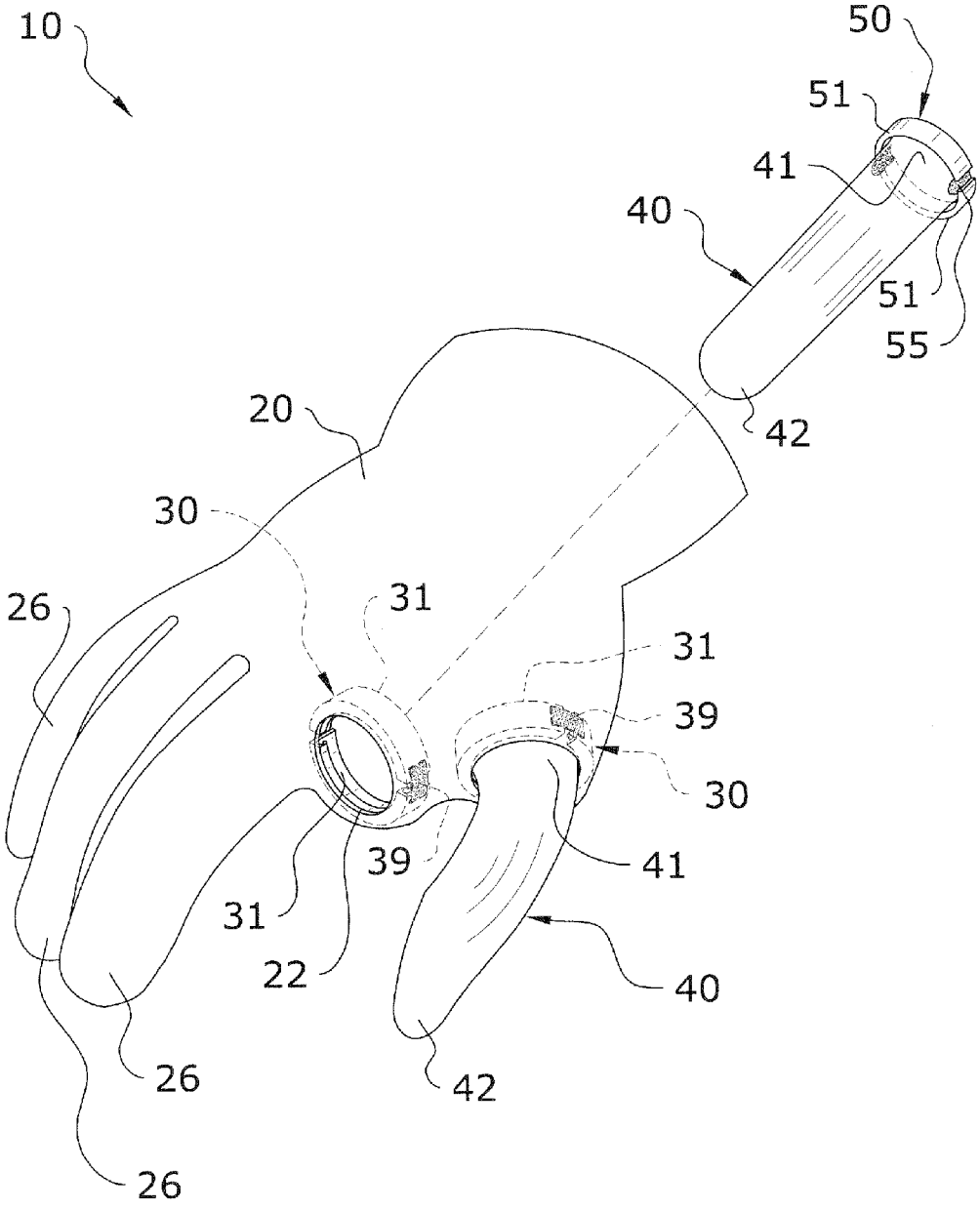
FIG. 1 is an upper perspective view of the present invention with one of the detachable segments (index finger) detached from the base portion and one of the detachable segments (thumb) attached to the base portion.
Figure 2:
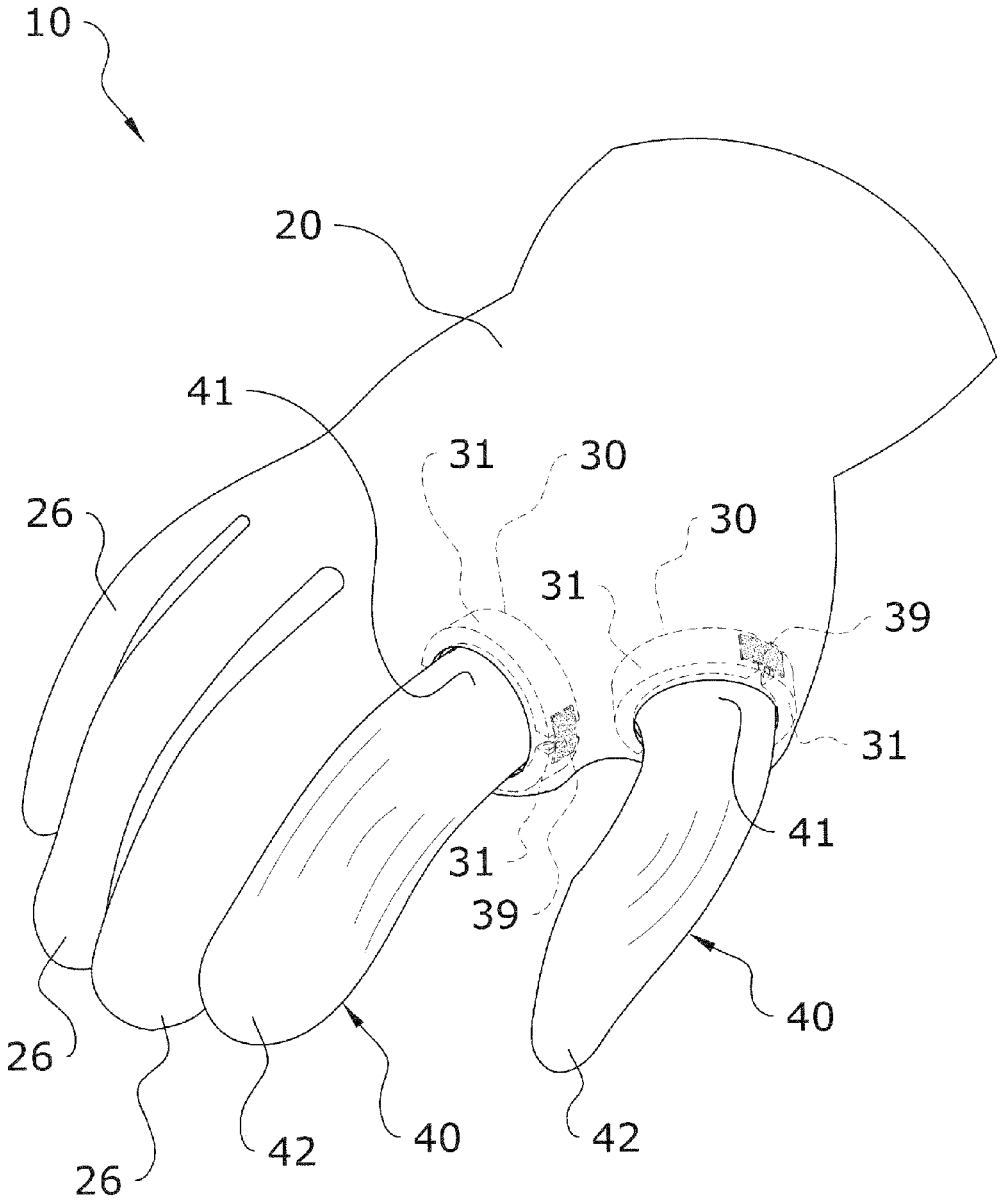
FIG. 2 is an upper perspective view of the present invention with both of the detachable segments attached to the base portion.
Figure 3:
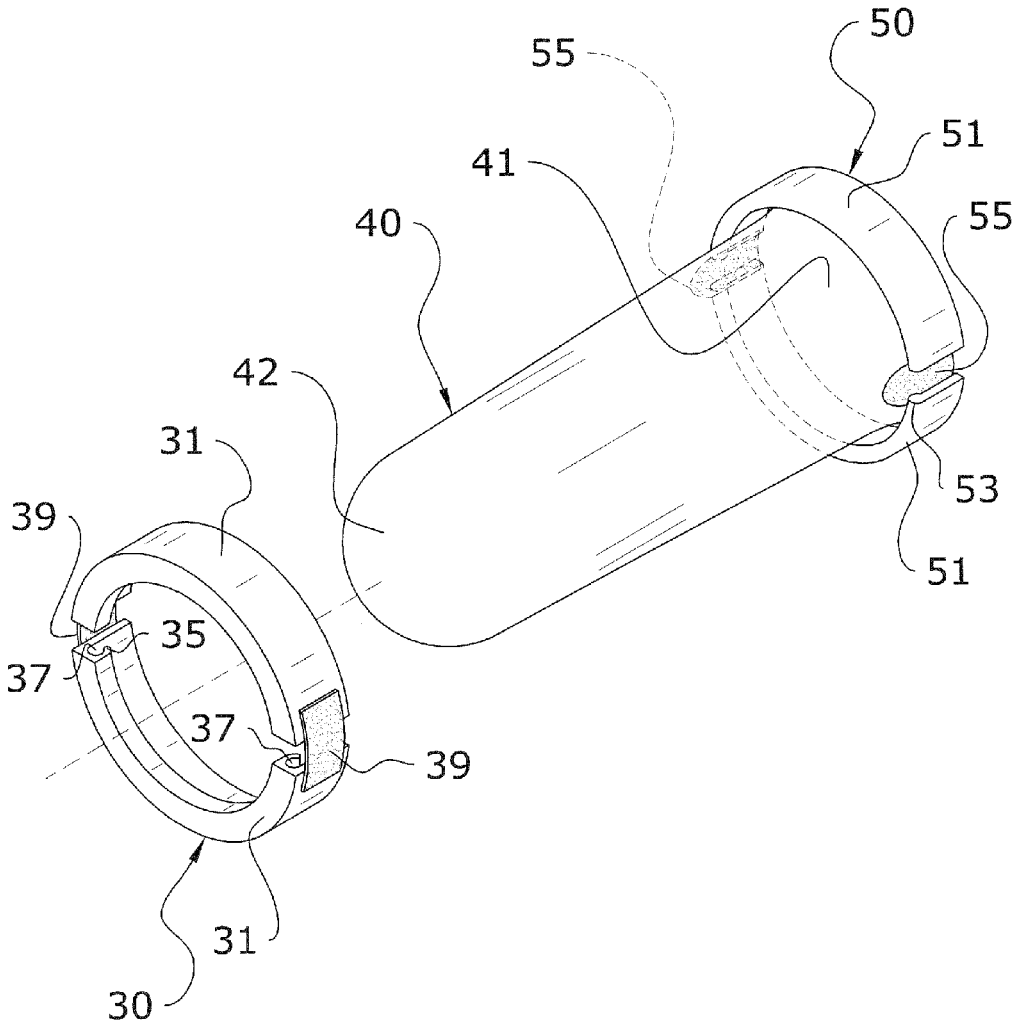
FIG. 3 is an upper perspective view of the detachable finger segment exploded from the base mount.
Figure 4:
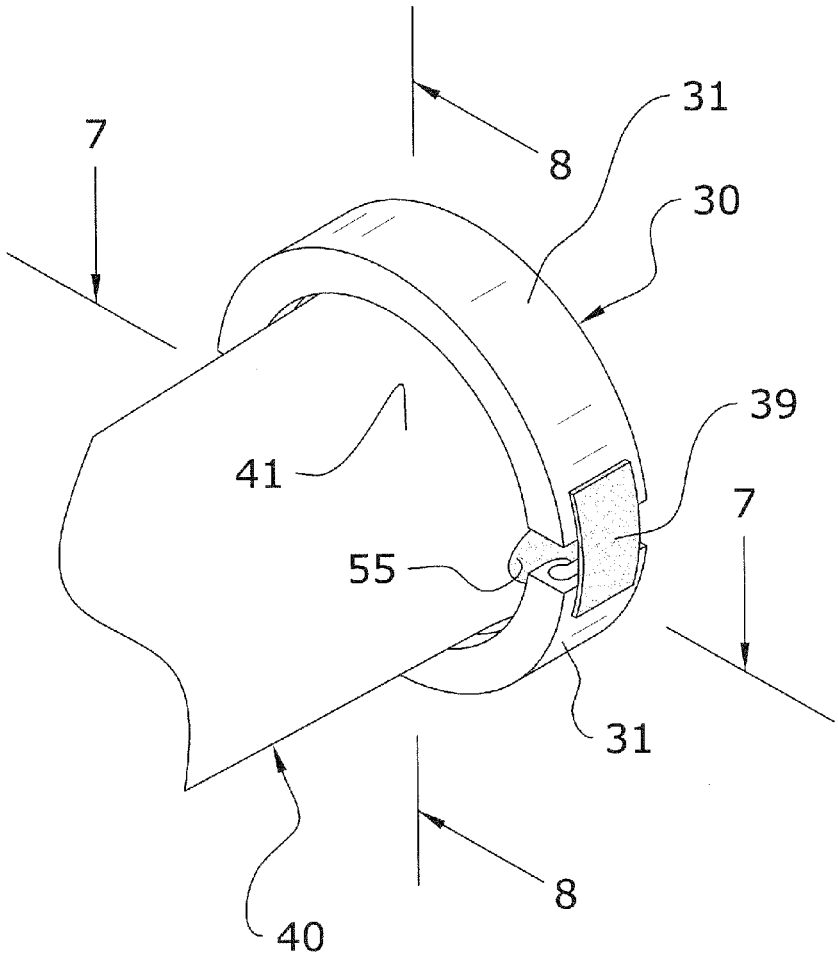
FIG. 4 is a cutaway upper perspective view of the detachable finger segment attached to the base mount.
Figure 5:
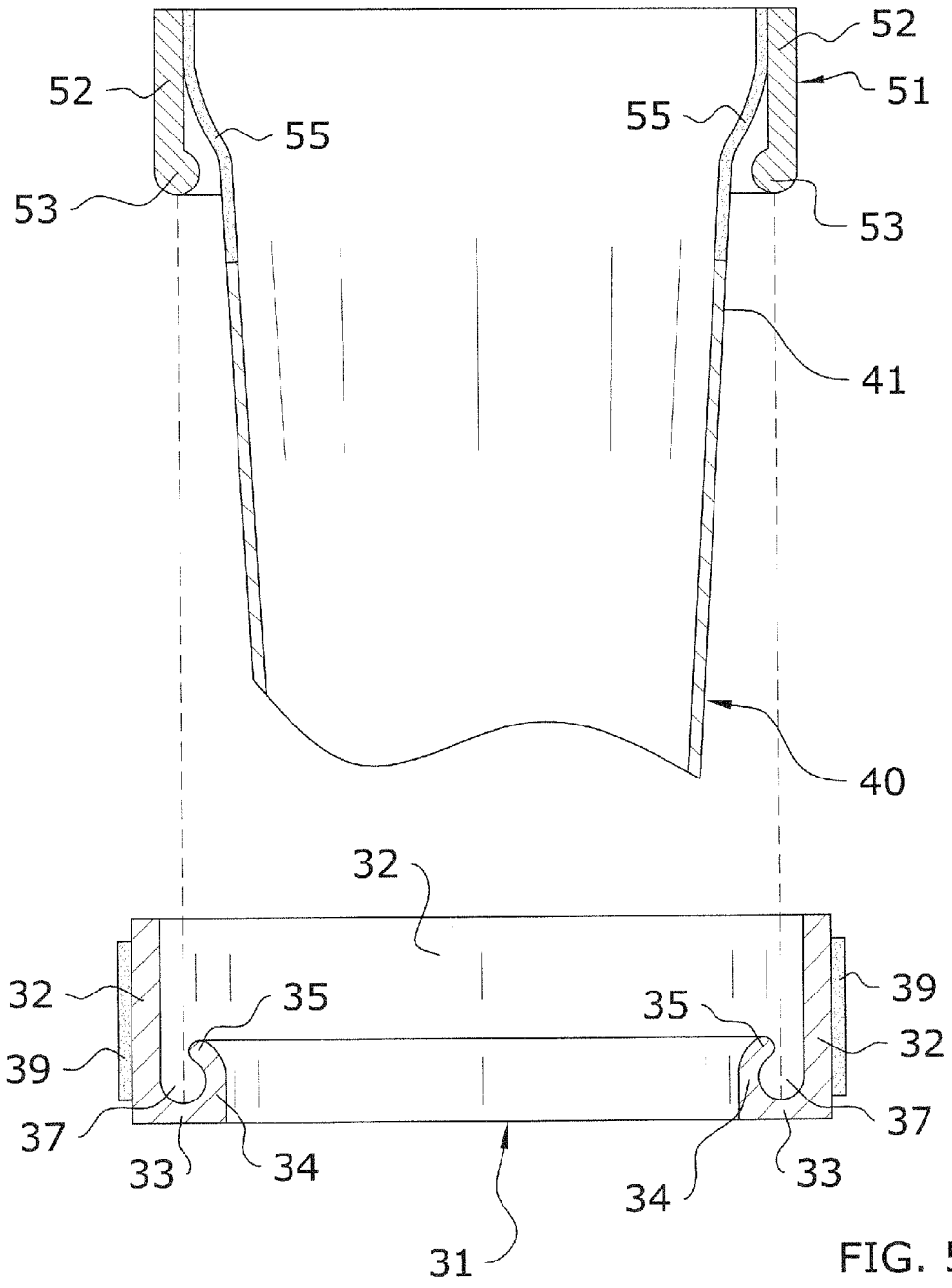
FIG. 5 is a cutaway cross-sectional view detachable finger segment detached from the base mount.
Figure 6:
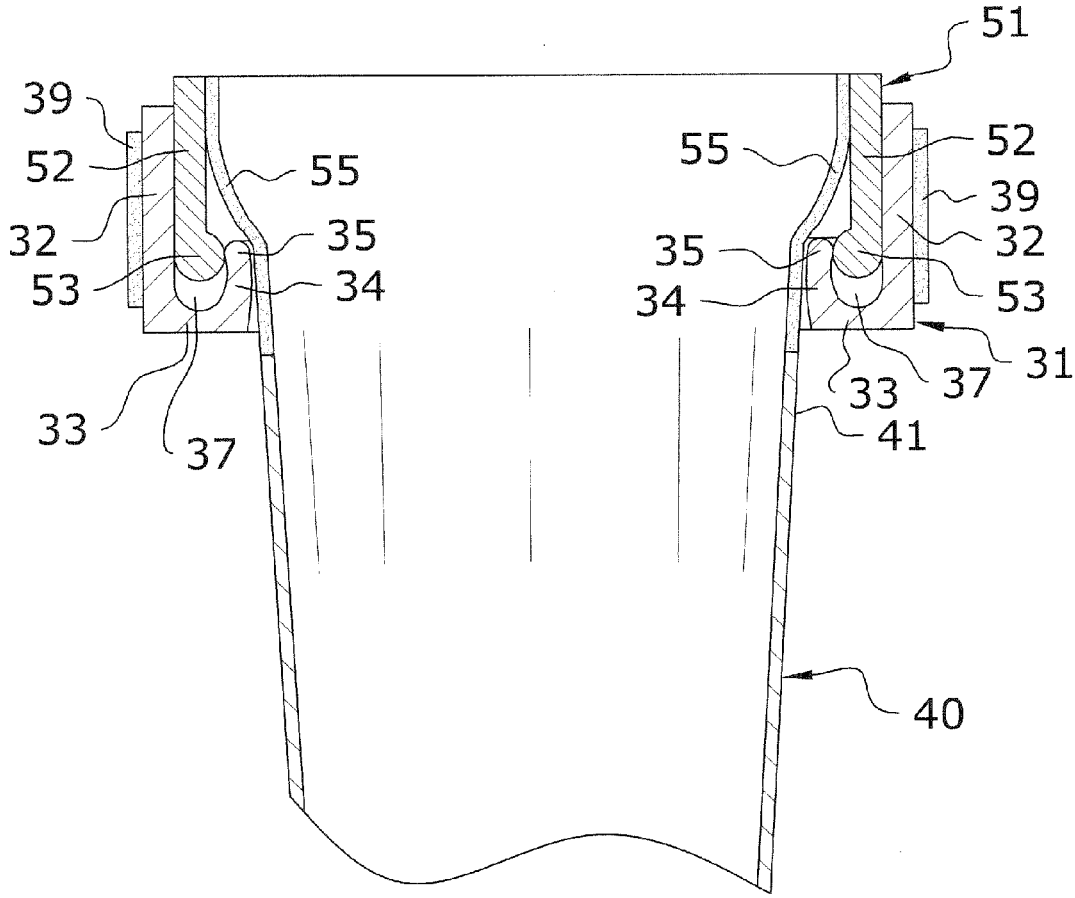
FIG. 6 is a cutaway cross-sectional view detachable finger segment being attached to the base mount.
Figure 7:
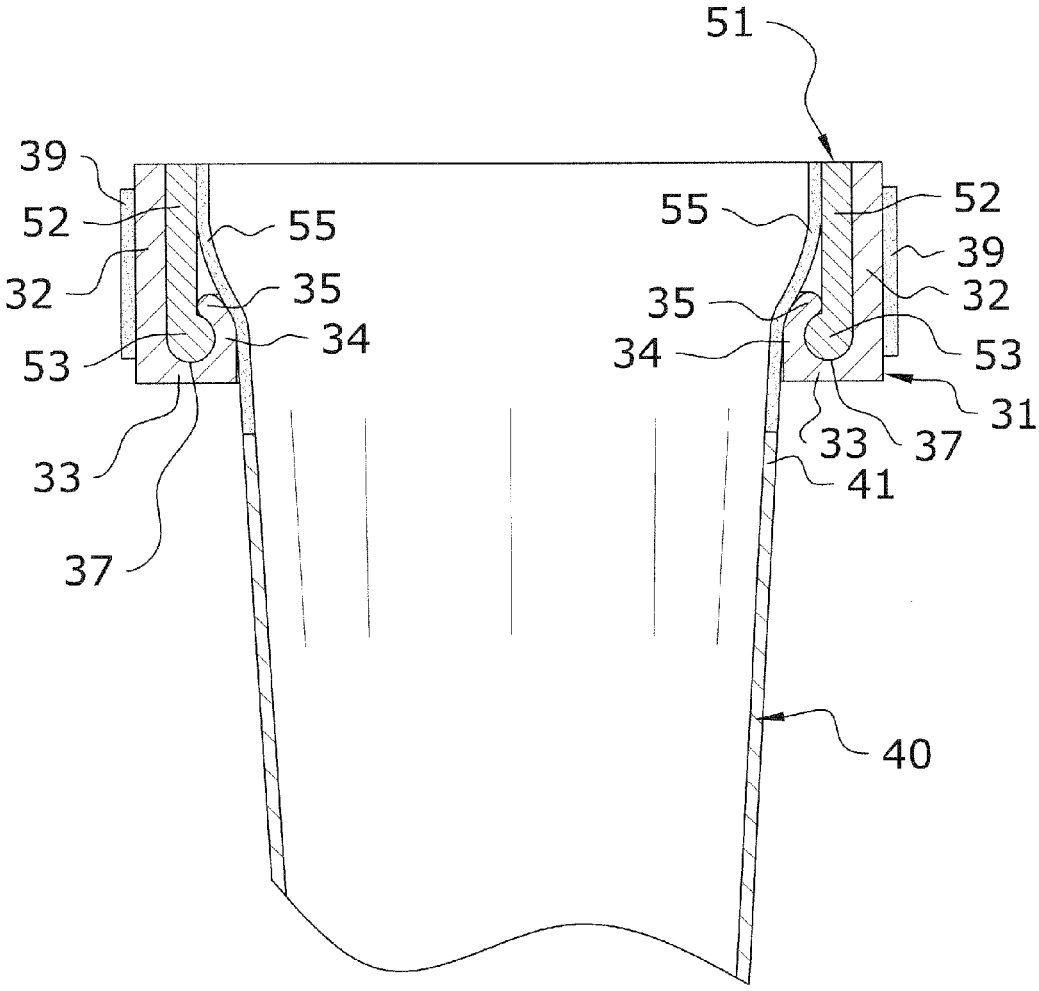
FIG. 7 is a sectional view taken along lines 7-7 of FIG. 4.
Figure 8:
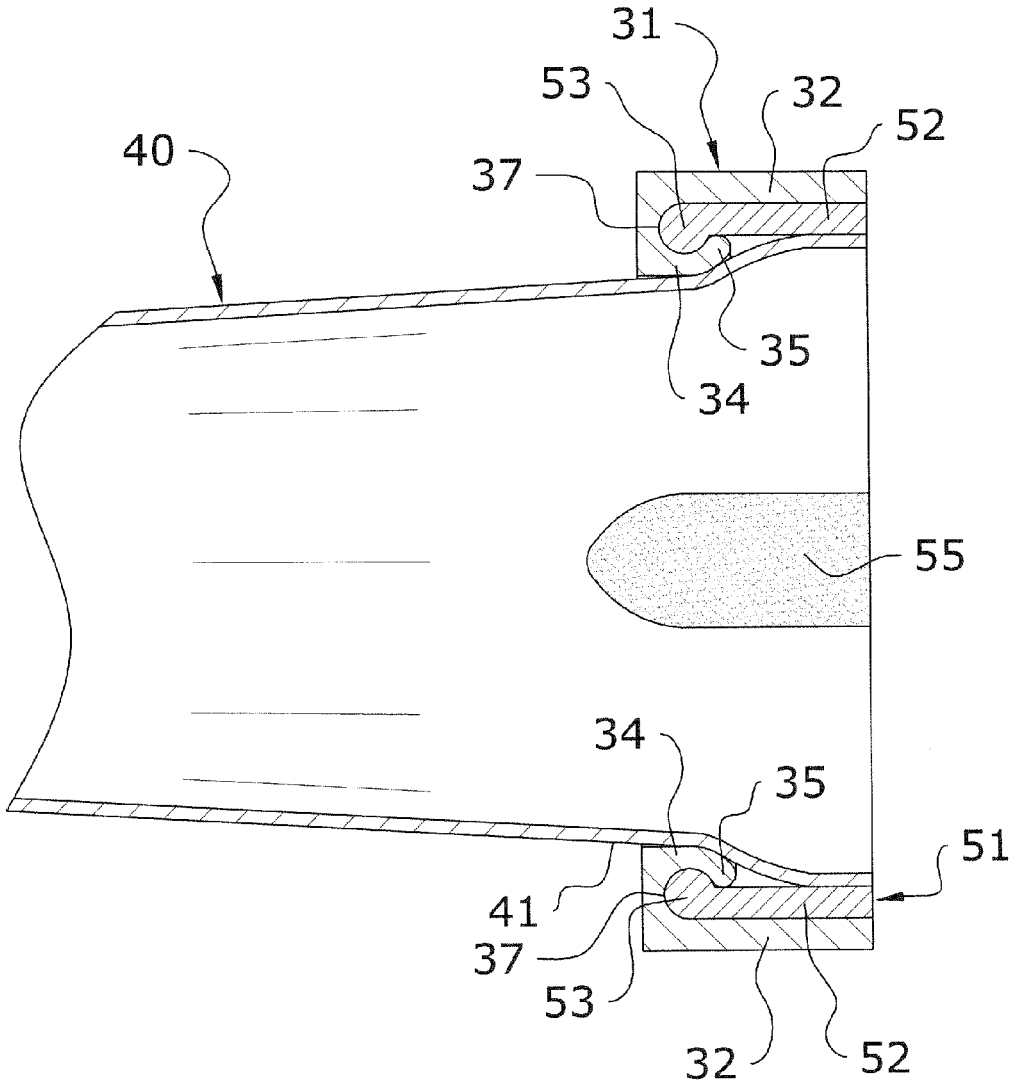
FIG. 8 is a sectional view taken along lines 8-8 of FIG. 4.

Turning now descriptively to the drawings, in which similar reference characters denote similar elements throughout the several views, FIGS. 1 through 8 illustrate a glove having detachable segments 10, which comprises a base portion 20 having a palm side and a back side adapted to cover a hand, the base portion 20 having integral finger segments 26 and also including detachable finger segments 40 to extend from the base portion 20. The base portion 20 includes base mounts 30 encircling finger openings 22 on an interior side and the detachable finger segments 40 include finger mounts 50 encircling the detachable finger segments 40 on an exterior side.

The detachable finger segments 40 extend through finger openings 22 of the base portion 20 and the finger mounts 50 interlock with the base mounts 30 to secure the detachable finger segments 40 to the base portion 20. The mounts 30, 50, when in the connected state, are located on an interior side of the base portion 20 to restrict visibility of the mounts 30, 50 and also restrict accidental engagement with foreign objects. The mounts 30, 50 each comprise a halved ring-structure having elastic elements 39, 55 connecting opposing halves 31, 51 for diametric adjustment of the mounts 30, 50. It is appreciated that the term "finger" herein may refer to any of the fingers (e.g. index finger, middle finger, ring finger, little or pinkie finger) of the hand as well as the thumb.

B. Base Portion

The base portion 20 is generally formed to fit over the palm and back side of the hand conventional to various types of gloves. The base portion 20, integral finger segments 26, and detachable finger segments 40 may be loose-fitting, tight-fitting, may be comprised of various fabrics, such as cloth, rubber, etc., may have various tactile elements thereon, have various layers of insulation, or be comprised of various other materials or structures suitable for the particular glove application. The base portion 20 may extend to the wrist of the user or beyond the wrist along the forearm, as well as be comprised of various other lengths.

The base portion 20 has one or more finger openings 22 extending through the forward end of the base portion 20 generally where the index and thumb fingers would extend through the base portion 20. The openings 22 are sized to correlate with the detachable finger segments 40 so that the seam between the base portion 20 and detachable finger segments 40 is substantially unnoticeable. It is appreciated that more or less finger openings 22 may be used when more or less detachable segments 40 are used.

The base portion 20 generally includes a plurality of integral finger segments 26 that are fixed to the base portion 20 and generally comprise the middle, ring, and little fingers. The integral finger segments 26 generally cover the middle, ring, and little fingers of the hand. It is appreciated that more or less integral finger segments 26 may be used to cover more or less fingers.

C. Base Mounts

The base portion 20 includes a base mount 30 at each finger opening 22. The base mount 30 generally encircles the finger opening 22 along a peripheral edge and is located along an interior side of the base portion 20 to be substantially non visible from an exterior side of the base portion 20 especially when the finger segment 40 is attached. The base mount 30 may be comprised of various materials, such as but not limited to plastic and may be comprised of various shapes, such as but not limited to ring shaped or circular, wherein the shape generally correlates with the shape of the finger opening 22 and the cross-sectional shape of the detachable finger segment 40.

The base mount 30 is generally divisible in sections, such as a pair of semi-circular sections 31. It is appreciated that the base mount 30 may alternately be comprised of a one-piece structure. In addition, the base mount 30 may be divisible into more sections if desired. The sections 31 may be comprised of equal lengths or different lengths.

The multiple sections 31 of the base mount 30 are preferably utilized to incorporate the resilient members 39. The resilient members 39 allow for diametric adjustment of the base mounts 30, wherein at least one resilient member 39 connects each end of the sections 31 to allow the sections 31 to slightly move relative each other as permitted by the flexibility and/or resiliency of the base portion 20 to permit a more comfortable and uniform entry of the detachable finger segment 40 and finger of the wearer. The resilient member 39 is generally comprised of a strip of elasticized material or other stretchable and resilient material. The resilient members 39 are generally affixed on an exterior part of the sections 31 of the base mount 30 to not interfere with the insertion of the finger mount 50.

The base mounts 30 preferably receive the finger mounts 50 within or along the interior of the base mounts 30 to not cause bulging of the base portion 20 along the perimeter of the base mounts 30. To interlock the finger mount 50 within the base mount 30, each of the sections 31 generally include an outer wall 32, an end wall 33, and an inner wall 34 including a catch portion 35 to define a slot 37.

The outer wall 32, the end wall 33, and the inner wall 34 each extend along a length of each of the sections 31, the outer wall 32 having a larger diameter than the inner wall 34. The end wall 33 generally extends inwardly from the distal end of the section 31 and the inner wall 34 extends perpendicular from the end wall 33 to parallel the outer wall 32. The inner wall 34 preferably only extends part-ways along the outer wall 32, wherein the outer wall 32 is comprised of a greater length than the inner wall 34. The outer wall 32, end wall 33, and inner wall 34 are generally integrally formed as appreciated.

The catch portion 35 extends from the end of the inner wall 34 (opposite the end wall 33) towards the outer wall 32 in a curved manner to partially enclose a slot 37 formed between the outer wall 32 and the inner wall 34. The distance between the catch portion 35 and the outer wall 32 is thus less than the distance between the inner wall 34 (that is adjacent the end wall 33) and the outer wall 32. The inner wall 34 including the catch portion 35 is able to pivot slightly about the end wall 33 to accommodate entry and removal of finger mount 50 when attaching and detaching the detachable finger segment 40.

D. Detachable Finger Segments

The glove 10 includes one or more detachable finger segments 40. The detachable finger segments 40 are removable and reattachable to the base portion 20 via the base mounts 30 and finger mounts 50. Generally, the detachable finger mounts 50 include the index finger covering and the thumb covering; however more or less detachable finger segments 40 may be utilized. The detachable finger segment 40 is generally comprised of a sleeve structure having an open first end 41 and a closed second end 42. The finger mount 50 substantially encircles the first end 41 of the detachable finger segment 40 on an exterior side of the detachable finger segment 40.

E. Finger Mounts

The detachable finger segment 40 includes a finger mount 50 at the first end 41 adjacent the opening within the detachable finger segment 40. As stated previously, the finger mount 50 encircles the first end 41 along a peripheral edge and is located along an exterior side of the detachable finger segment 40 to be substantially non visible from an exterior side of the detachable finger segment 40 when positioned within the base mount 30 of the base portion 20. The finger mount 50 is generally attached to the inside of the finger mount 50 along a substantial perimeter of the finger mount 50. In areas where the resilient member 55 is located, the finger segment 40 may overlap the resilient member 55 or be attached or adjacent to the peripheral edge of the resilient member 55.

The finger mount 50 may be comprised of various materials, such as but not limited to plastic and may be comprised of various shapes, such as but not limited to ring shaped or circular, wherein the shape generally correlates with the shape of the finger opening 22 and the cross-sectional shape of the detachable finger segment 40.

The finger mount 50 is generally divisible in sections, such as a pair of semi-circular sections 51. It is appreciated that the finger mount 50 may alternately be comprised of a one-piece structure. In addition, the finger mount 50 may be divisible into more sections if desired. The sections 51 may be comprised of equal lengths or different lengths.

The multiple sections 51 of the finger mount 50 are preferably utilized to incorporate the resilient members 55, similar to the base mounts 30. The resilient members 55 allow for diametric adjustment of the finger mounts 50, wherein at least one resilient member 55 connects each end of the sections 51 to allow the sections 51 to slightly move relative each other as permitted by the flexibility and/or resiliency of the detachable finger segment 40 to permit a more comfortable and uniform entry of the detachable finger segment 40 and finger of the wearer. The resilient member 55 is generally comprised of a strip of elasticized material or other stretchable and resilient material. The resilient members 55 are generally affixed on an exterior part of the sections 51 of the finger mount 50 to not interfere with the insertion of the finger mount 50.

The finger mounts 50 are received within base mounts 30 and are substantially concealed by the base mounts 30, wherein the base mount 30 is concealed by the base portion 20. Each of the sections 51 of the finger mounts 50 include an elongated portion 52 comprised of a length similar to the outer wall 32 of the respective section 31 of the base mount 30 to prevent the finger mount 50 from twisting or moving when inserted within the base mount 30.

Extending inwardly from a distal end of the elongated portion 52 is a bulge portion 53. The bulge portion 53 and the elongated portion 52 each preferably extend an entire length of the respective section 51. The bulge portion 53 is received within the slot 37 of the respective section 31 of the base mount 30 past the catch portion 35. The diameter of the bulge portion 53 is generally substantially equal to the diameter of the slot 37. The width of the elongated portion 52 is generally substantially equal to the width between the catch portion 35 and the outer wall 32 so that the catch portion 35 and inner wall 34 is able to pivot back to an initial position when the finger mount 50 is inserted within (in a connected state) to the base mount 30.

F. Operation of Preferred Embodiment

In use, to attach a give detachable finger segment 40, the closed second end 42 of the detachable finger segment 40 is extended through the finger opening 22 away from the base portion 20 until the first end 41 and finger mount 50 of the detachable finger segment 40 reaches the base mount 30. The bulge portion 53 is then ensured to be aligned with the slot 37 and the detachable finger segment 40 is continued to be pulled through the finger opening 22 until the bulge portion 53 moves past the catch portion 35 and into the slot 37 of the base mount 30 thus locking the finger mount 50 within the base mount 30 and securing the detachable finger segment 40 to the base portion 20. The above may be accomplished with the user's finger already inserted within the detachable finger segment 40 or the user may afterwards insert their finger within detachable linger segment 40 and base portion 20.

When removing the detachable finger segment 40, direct pressure may be applied to the finger mount 50 in a reverse direction to cause the inner wall 34 to pivot inwardly so that the bulge portion 53 may be removed from the slot 37 and the finger mount 50 removed from the base mount 30. Alternately, the user may simply pull upon the detachable finger segment 40 in a reverse direction thus forcing the finger mount 50 to detach from the base mount 30 by forcing the bulge portion 53 out of the slot 37.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A glove having detachable fingers, comprising:

a base portion having a palm side and a back side adapted to cover a hand, wherein said base portion includes at least one finger opening;

at least one detachable finger segment to extend through said at least one figure opening and connect to said base portion; and at least one mounting means to connect said at least one detachable finger segment to said base portion, wherein said mounting means is adapted to slidably connect said at least one detachable finger segment to said base portion via pulling said at least one detachable finger segment through said at least one finger opening and wherein said mounting means being located on an interior side of said base portion in a connected state and be substantially covered by said base portion to substantially conceal said mounting means from an exterior side of said base portion, wherein said mounting means comprises a base mount located on an interior side of said base portion, and a finger mount located on an exterior side of said at least one finger segment, wherein said finger mount is positioned within said base mount when connected to said base mount.

2. The glove having detachable fingers of claim 1, wherein said base portion has at least one integral finger segment.

3. The glove having detachable fingers of claim 1, wherein said mounting means has a diametric adjustment means.

4. The glove having detachable fingers of claim 3, wherein said diametric adjustment means is comprised of elastic strips.

5. The glove having detachable fingers of claim 1, wherein said base mount has a pivotal catch portion forming a partially enclosed slot at a distal end of said base mount, said finger mount has a bulge portion at a distal end of said finger mount, said bulge portion adapted to slide past said pivotal catch portion and be received and secured within said partially enclosed slot.

6. The glove having detachable fingers of claim 1, wherein both said base mount and said finger mount are comprised of a ring structure.

7. The glove having detachable fingers of claim 1, wherein both said base mount and said finger mount are comprised of a ring structure, wherein said both base mount and said finger mount include a diametric adjustment means, wherein said diametric adjustment means is comprised of elastic strips connecting first and second semi-circular sections of said ring structure of said base mount and connecting first and second semi-circular sections of said ring structure of said finger mount.

8. A glove having detachable fingers, comprising:

a base portion having a palm side and a back side adapted to cover a hand, wherein said base portion includes at least two finger openings;

at least two detachable finger segments to extend through said at least two figure openings and connect to said base portion; and at least two mounting means to each connect one of said at least two detachable finger segments to said base portion, wherein each said mounting means is adapted to slidably connect to one of said at least two detachable finger segments to said base portion via pulling said detachable finger segment through said finger opening and wherein each said mounting means being located on an interior side of said base portion in a connected state and be substantially covered by said base portion to substantially conceal said mounting means from an exterior side of said base portion, wherein each said mounting means comprises a base mount located on an interior side of said base portion, and a finger mount located on an exterior side of said at least one finger segment, wherein said finger mount is positioned within said base mount when connected to said base mount.

9. The glove having detachable fingers of claim 8, wherein said base portion has at least one integral finger segment.

10. The glove having detachable fingers of claim 8, wherein each said mounting means has a diametric adjustment means.

11. The glove having detachable fingers of claim 10, wherein said diametric adjustment means is comprised of elastic strips.

12. The glove having detachable fingers of claim 8, wherein said base mount has a pivotal catch portion forming a partially enclosed slot at a distal end of said base mount, said finger mount has a bulge portion at a distal end of said finger mount, said bulge portion adapted to slide past said pivotal catch portion and be received and secured within said partially enclosed slot.

13. The glove having detachable fingers of claim 8, wherein both said base mount and said finger mount are comprised of a ring structure.

14. The glove having detachable fingers of claim 13, wherein both said base mount and said finger mount are comprised of a ring structure, wherein said both base mount and said finger mount include a diametric adjustment means, wherein said diametric adjustment means is comprised of elastic strips connecting first and second semi-circular sections of said ring structure of said base mount and connecting first and second semi-circular sections of said ring structure of said finger mount.

15. A glove having detachable fingers, comprising:

a base portion having a palm side and a back side adapted to cover a hand, wherein said base portion includes two finger openings, said two finger openings including an index finger opening and a thumb opening;

wherein said base portion has at least one integral finger segment fixed thereto;

two detachable finger segments to extend through said two figure openings and connect to said base portion, said two detachable finger segments comprised of an index finger segment and a thumb finger segment; and two mounting means to connect each one of said detachable finger segments to said base portion, wherein each said mounting means is adapted to slidably connect to one of said two detachable finger segments to said base portion via pulling said detachable finger segment through said finger opening and wherein each said mounting means being located on an interior side of said base portion in a connected state and be substantially covered by said base portion to substantially conceal said mounting means from an exterior side of said base portion;

wherein each said mounting means comprises a base mount located on an interior side of said base portion and a finger mount located on an exterior side of said finger segment, wherein said finger mount is positioned within said base mount when connected to said base mount;

wherein said base mount has a pivotal catch portion forming a partially enclosed slot at a distal end of said base mount, said finger mount has a bulge portion at a distal end of said finger mount, said bulge portion adapted to slide past said pivotal catch portion and be received and secured within said partially enclosed slot;

wherein both said base mount and said finger mount are comprised of a ring structure;

wherein said both base mount and said finger mount include a diametric adjustment means, wherein said diametric adjustment means is comprised of elastic strips connecting first and second semi-circular sections of said ring structure of said base mount and connecting first and second semi-circular sections of said ring structure of said finger mount.

16. A glove having detachable fingers, comprising:

a base portion having a palm side and a back side adapted to cover a hand, wherein said base portion includes at least one finger opening;

at least one detachable finger segment to extend through said at least one figure opening and connect to said base portion; and at least one mounting means to connect said at least one detachable finger segment to said base portion, wherein said mounting means is adapted to slidably connect said at least one detachable finger segment to said base portion via pulling said at least one detachable finger segment through said at least one finger opening and wherein said mounting means being located on an interior side of said base portion in a connected state and be substantially covered by said base portion to substantially conceal said mounting means from an exterior side of said base portion, wherein said mounting means comprises a base ring mount encircling said at least one figure opening, said base ring mount located on an interior side of said base portion, and a finger ring mount encircling said at least one finger segment, wherein said finger ring mount is located on an exterior side of said finger segment and wherein said finger ring mount adapted to slidably connect to said base ring mount.

17. The glove having detachable fingers of claim 16, wherein said base portion has at least one integral finger segment.

18. The glove having detachable fingers of claim 16, wherein said mounting means has a diametric adjustment means.

19. The glove having detachable fingers of claim 18, wherein said diametric adjustment means is comprised of elastic strips.

20. A glove having detachable fingers, comprising:

a base portion having a palm side and a back side adapted to cover a hand, wherein said base portion includes at least two finger openings;

at least two detachable finger segments to extend through said at least two figure openings and connect to said base portion; and at least two mounting means to each connect one of said at least two detachable finger segments to said base portion, wherein each said mounting means is adapted to slidably connect to one of said at least two detachable finger segments to said base portion via pulling said detachable finger segment through said finger opening and wherein each said mounting means being located on an interior side of said base portion in a connected state and be substantially covered by said base portion to substantially conceal said mounting means from an exterior side of said base portion, wherein each said mounting means comprises a base ring mount encircling said figure opening, said base ring mount located on an interior side of said base portion, and a finger ring mount encircling said finger segment, wherein said finger ring mount is located on an exterior side of said finger segment and wherein said finger ring mount is adapted to slidably connect to said base ring mount.

21. The glove having detachable fingers of claim 20, wherein said base portion has at least one integral finger segment.

22. The glove having detachable fingers of claim 20, wherein each said mounting means has a diametric adjustment means.

23. The glove having detachable fingers of claim 22, wherein said diametric adjustment means is comprised of elastic strips.

* * * * *